US005575594A

United States Patent [19]

Kurtz et al.

[11] Patent Number: 5,575,594

[45] Date of Patent: Nov. 19, 1996

[54] MODULAR RAIL CAR UNLOADING PIT AND METHOD OF USING THE SAME

[75] Inventors: Steven C. Kurtz, Hummelstown, Pa.; Michael S. Tuculescu, Ridgewood, N.J.

[73] Assignee: Tarmac Minerals, Inc., Annville, Pa.

[21] Appl. No.: 483,706

[22] Filed: Jun. 7, 1995

[51] Int. Cl.[6] ..... E02D 29/00; B61B 1/00; B65F 9/00; B65G 67/00

[52] U.S. Cl. ..... 405/303; 52/169.1; 104/27; 414/339; 414/373; 414/376

[58] Field of Search ..... 52/169.1, 19; 104/27, 104/29; 414/387, 388, 327, 373, 376; 405/284, 286, 303, 282

[56] References Cited

U.S. PATENT DOCUMENTS

| | | | |
|---|---|---|---|
| 3,799,620 | 3/1974 | Robinson et al. | 302/15 |
| 3,993,203 | 11/1976 | Bartley | 214/45 |
| 4,048,773 | 9/1977 | Laven | 52/169 |
| 4,142,339 | 3/1979 | Crowley | 52/224 |
| 4,185,430 | 1/1980 | Gartung | 52/285 |
| 4,291,803 | 9/1981 | Perales | 206/443 |
| 4,635,304 | 1/1987 | Zikmanis et al. | 4/506 |
| 4,685,837 | 8/1987 | Cicanese | 405/282 |
| 4,748,783 | 6/1988 | Labelle | 52/595 |
| 4,782,538 | 11/1988 | Chisholm et al. | 4/506 |
| 4,865,213 | 9/1989 | Kruger | 220/76 |
| 4,925,356 | 5/1990 | Snead et al. | 414/339 |
| 4,975,012 | 12/1990 | Motoda | 414/279 |

*Primary Examiner*—Tamara L. Graysay
*Assistant Examiner*—Tara L. Mayo
*Attorney, Agent, or Firm*—Banner & Allegretti, Ltd.

[57] ABSTRACT

A modular rail car unloading pit which supports railroad tracks and facilitates the removal and transfer of aggregate, particulate, or other material from rail cars. The modular unloading pit is comprised of a set of precast concrete panels enabling the unloading pit to be environmentally friendly, reusable, and reducing installation time and cost. The set of panels includes one or more floor panels, four equally spaced vertical lateral walls oriented perpendicular to the railroad tracks, and a vertical longitudinal wall oriented parallel to the railroad tracks. Each lateral wall includes rail support plates at the top and anchors protruding from the bottom. The anchors are inserted into corresponding anchor receiving orifices in the floor for connecting the lateral walls to the floor. The lower end of the lateral walls are capped by metal channel members which are welded to metal plates on the top surface of the floor. The longitudinal wall is notched enabling it to interface with an end of each lateral wall. A conveyor system is mounted between each pair of lateral walls for transporting the material discharged from bottom unloading rail cars to an above-ground area away from the railroad tracks.

24 Claims, 4 Drawing Sheets

MODULAR RAIL CAR UNLOADING PIT AND METHOD OF USING THE SAME

FIELD OF THE INVENTION

This invention relates to a rail car unloading pit which is placed beneath railroad tracks for facilitating the removal and transfer of material from rail cars. More specifically, this invention relates to a modular rail car unloading pit comprised of precast concrete panels enabling it to be environmentally friendly and reusable, and reducing installation time and cost.

BACKGROUND OF THE INVENTION

Rail car unloading pits are underground structures located below railroad tracks which support the railroad tracks and receive aggregate, particulate, or other material unloaded from rail cars. Rail car unloading pits typically consist of a floor and vertical walls which form one or more compartments. A conveying system, usually a series of belt conveyers placed in end-to-end fashion, is placed inside each compartment. A rail car containing a desired material is transported along the railroad tracks and is positioned to longitudinally straddle the unloading pit. Doors on the bottom of the rail car are opened and the material inside the rail car is discharged under the influence of gravity into the unloading pit. The discharged material is transferred by the conveying system from the pit to a remote location. As described below, prior unloading pits have been: (i) expensive and time consuming to install, (ii) non-reusable, and (iii) environmentally disagreeable.

Prior rail car unloading pits have been formed by excavating a site and pouring concrete in the excavation to a desired unloading pit shape, i.e., they are cast-in-place. Many cast-in-place unloading pits take three-to-four weeks and a significant number of man-hours to install due to their size, amount of concrete required, and concrete setting requirements.

In addition, after a cast-in-place unloading pit is no longer required at a site, its useful life is over and the pit is backfilled with dirt. However, backfilling a cast-in-place unloading pit is detrimental to the environment because all the concrete permanently remains underneath the ground surface. Even if one would attempt to remove a cast-in-place unloading pit from the excavation, it would be extremely costly and would still likely leave concrete remains underneath the ground surface, as the unloading pit would have to be forcibly broken into pieces and carried away.

There is a need, therefore, for an unloading pit which is inexpensive and time efficient to install, reusable, and environmentally friendly.

SUMMARY OF THE INVENTION

It is therefore an object of the present invention to provide a modular unloading pit having precast concrete panels which can be formed off-site to significantly reduce installation time and cost.

It is a further object of the invention to provide a modular unloading pit which can be disassembled and reused to decrease costs and reduce damage to the environment.

It is another object of the invention to provide a modular unloading pit which is environmentally friendly.

It is yet another object of the invention to provide a lower cost method of shipping material by rail car to a locale a significant distance away from its point of production or storage facility.

These and other objects are achieved by the present invention which, according to one aspect, provides a modular unloading pit containing a conveyer system to transport material unloaded from a rail car. The modular unloading pit is located beneath, and supports, at least one rail for guiding the rail car. The modular unloading pit includes a precast concrete floor, and a plurality of precast concrete lateral vertical walls oriented perpendicular to the rail. The floor includes a wall interfacing structure for interfacing with, and supporting, the lateral vertical walls. The lateral vertical walls include a floor interfacing structure for interfacing with the wall interfacing structure of the floor. Each lateral vertical wall further includes a rail supporting structure for contacting and supporting the rail.

In another aspect, the invention provides a method for unloading material from rail cars. A set of precast concrete panels is assembled inside an excavation at a first site to form a rail car unloading pit. A material conveying device is positioned inside the rail car unloading pit. Material is discharged from a rail car into the rail car unloading pit and conveyed away from the rail car unloading pit by the conveying device. The rail car unloading pit is disassembled. The set of precast concrete panels is transported to a second site and reassembled inside an excavation at the second site to form a second rail car unloading pit. A conveying device is positioned inside the second rail car unloading pit at the second site. Additionally, material is discharged from a rail car into the second rail car unloading pit at the second site and is conveyed away from the second rail car unloading pit by the conveying device at the second site.

In yet another aspect, the invention provides a rail car unloading pit having a floor, a plurality of lateral walls and a longitudinal wall. The lateral walls are attached to, and supported by, the floor, and the longitudinal wall is supported by the floor and is attached to the lateral walls. The lateral walls are oriented substantially perpendicular to the longitudinal wall. At least one rail supporting member is attached to each lateral wall for supporting a rail substantially perpendicular to the lateral walls and substantially parallel to the longitudinal wall. The floor and the walls are comprised of precast concrete panels. Either the floor or the lateral walls includes anchoring projections, while the other includes anchor receiving sleeves. Each anchoring projection is located within a respective anchor receiving sleeve to accurately position the lateral walls with respect to the floor and restrict relative movement between the lateral walls and the floor.

Further objects, features and other aspects of this invention will be understood from the following detailed description of the preferred embodiments of this invention with reference to the attached drawing figures.

DETAILED DESCRIPTION

Figure 1:
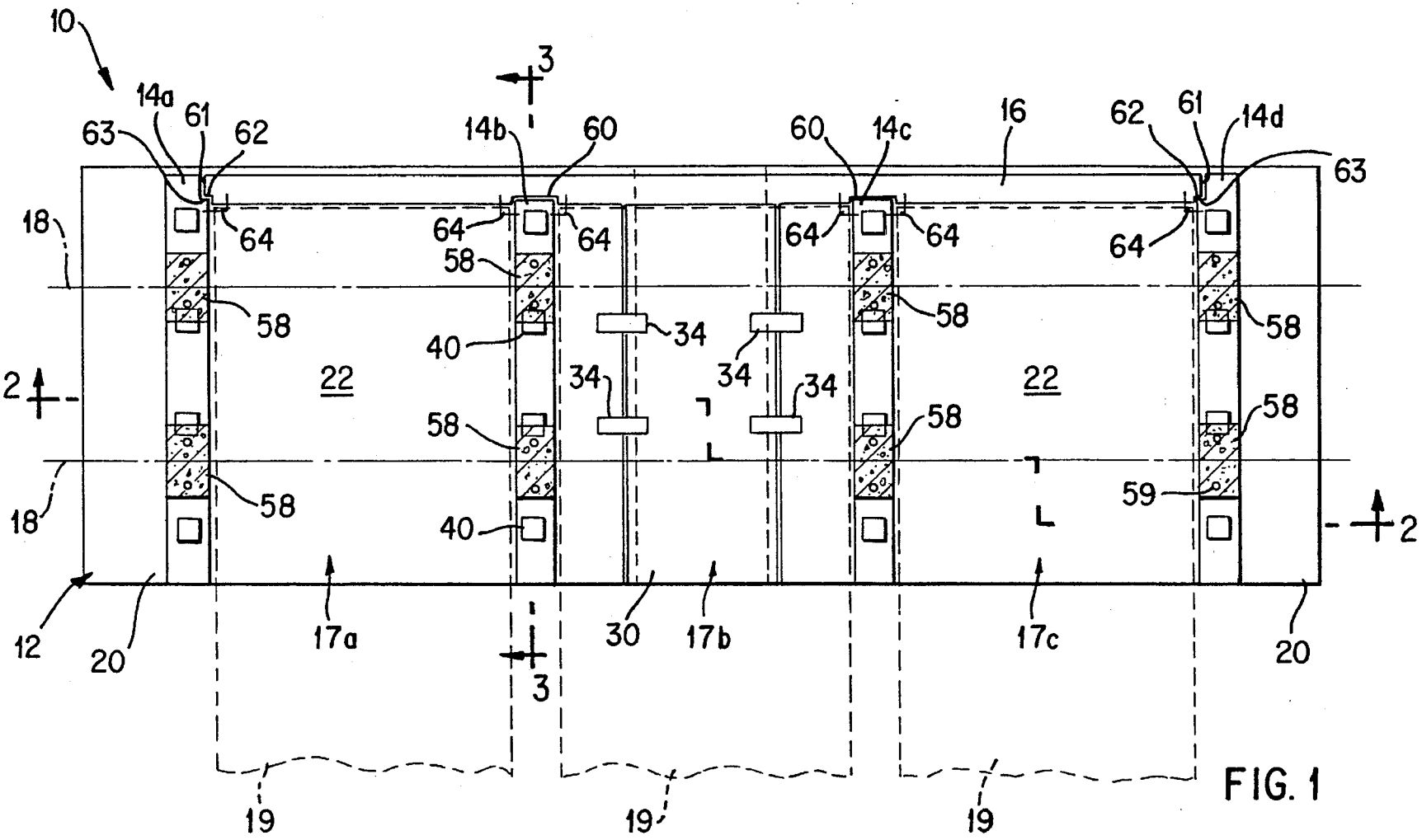
FIG. 1 is an top plan view of the modular rail car unloading pit of the present invention.

Referring to the figures, reference numeral 10 generally designates a modular rail car unloading pit embodying the present invention. Modular unloading pit 10 is comprised of precast concrete panels arranged to form a floor 12, lateral walls 14*a*–14*d*, and a longitudinal wall 16. As described hereinafter, floor 12, lateral walls 14, and longitudinal walls 16 are produced off-site, transported to the site, and assembled on-site to form modular unloading pit 10.

As shown in FIG. 1, railroad tracks, schematically indicated by reference numeral 18, are oriented substantially parallel to longitudinal wall 16 and substantially perpendicular to lateral walls 14. Railroad tracks 18 are supported above unloading pit 10 by lateral walls 14. In operation, a rail car, not shown, containing material, e.g., aggregate, particulate, sand, salt, coal, grain, etc., is transported along railroad tracks 18 and is positioned to longitudinally straddle unloading pit 10. Doors on the bottom or the lower side of the rail car are opened. The material inside the rail car is discharged under the influence of gravity into unloading pit 10.

In an assembled state, the spaces between adjacent lateral walls 14, above floor 12 and below tracks 18, and laterally inward of longitudinal wall 16, define unloading compartments 17*a*–17*c*. Conveying devices 19 are mounted within each unloading compartment 17 and transport material discharged from a rail car to a remote site. Conveying devices 19 are known in the art and can be a single conveyor or combination of conveyors. Further, conveying devices 19 may also include angled guide walls for channelling all of the discharged material onto the conveyors.

To facilitate transportation to and from the site, floor 12 is preferably comprised of more floor panels 20. In the preferred embodiment, floor 12 includes two longitudinally spaced floor panels 20 and a center joining panel 30. Floor panels 20 each include an upwardly facing ledge 32 for receiving, supporting, and aligning center panel 30. Center panel 30 serves to "key-in" both floor panels 20 and transfer forces between floor panels 20. Fastening hardware 34, e.g., brackets and bolts, is utilized to fixedly attach center joining panel 30 to both floor panels 20. It is recognized that center joining panel 30 may be eliminated, and two or more directly connected floor panels 20 may be used. Further, while it is possible that floor 12 could consist of a single panel, such an arrangement may not be preferable due to the limitations associated with transporting and handling a panel of such a size and weight.

Figure 2:
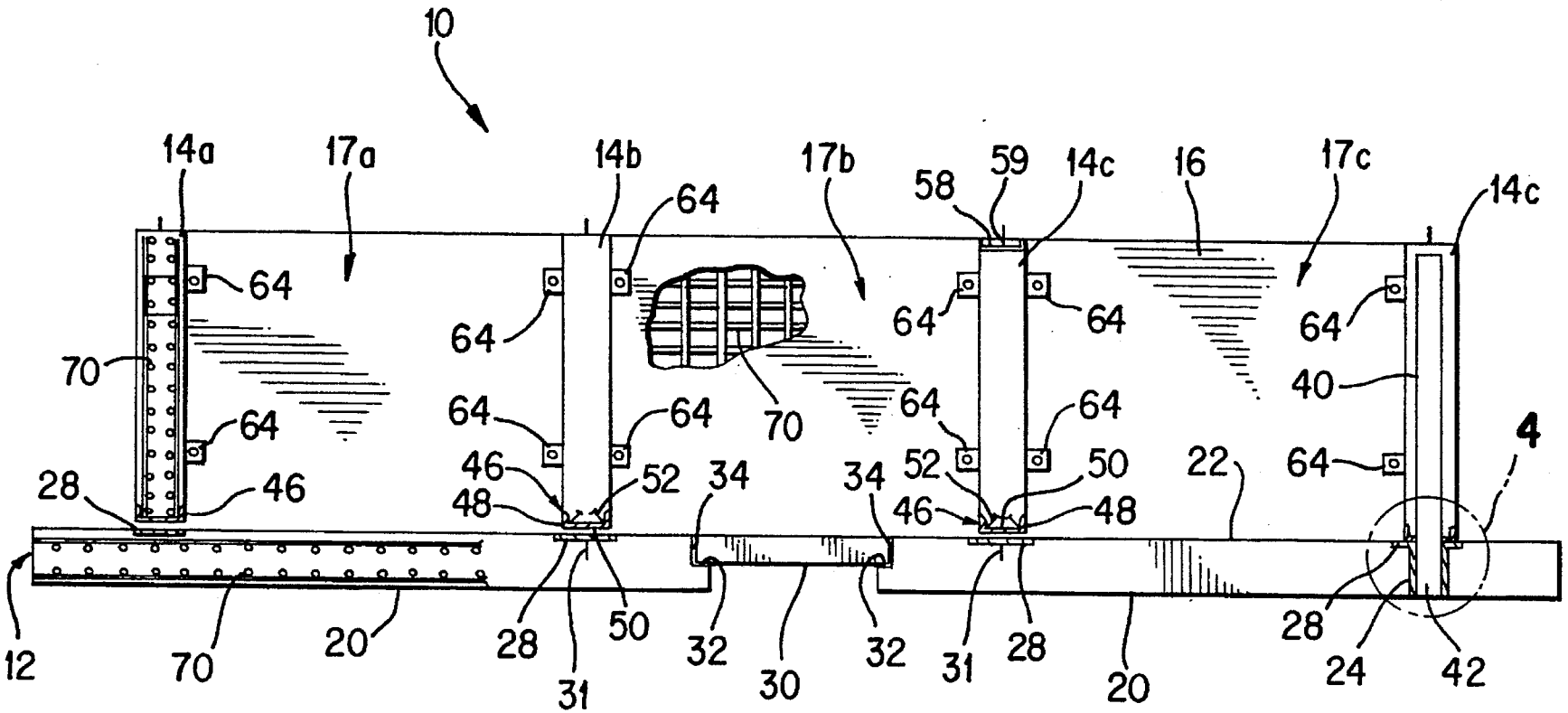
FIG. 2 is a sectional view taken through line 2—2 of FIG. 1.
Figure 3:
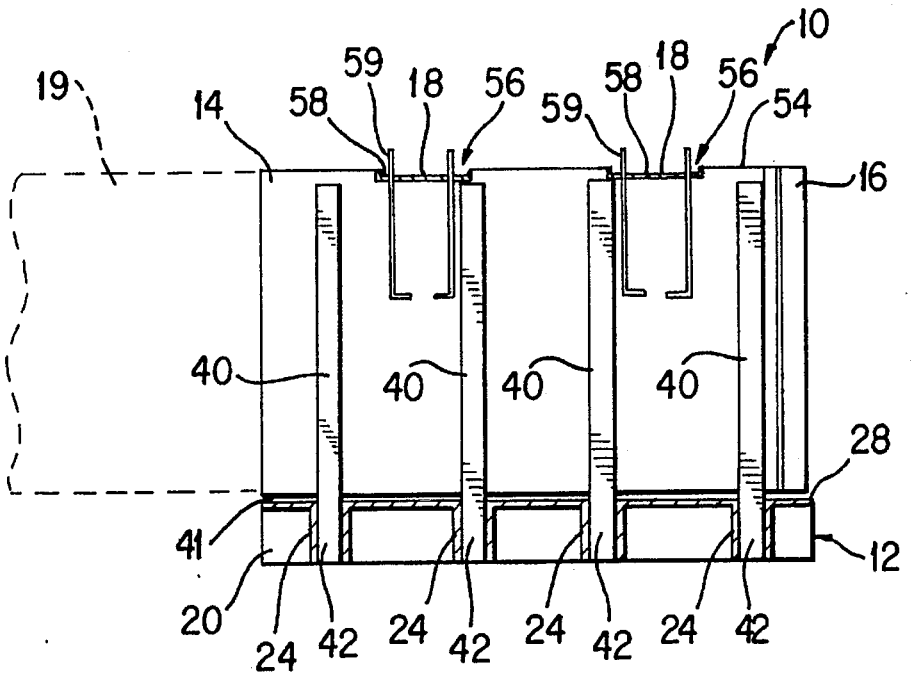
FIG. 3 is a sectional view taken through line 3—3 of FIG. 1.

Floor 12, and more specifically floor panels 20, includes an upper surface 22 and a plurality of wall panel interface members to interface with vertical lateral walls 14. Wall panel interface members are preferably anchor receiving orifices 24 arranged and spaced in floor 12 in a predetermined array corresponding to the number of lateral walls 14 in unloading pit 10, and the number of anchoring projections 42 extending from each lateral wall 14. In the embodiment of FIGS. 1–3, there are four lateral walls 14 with each lateral wall 14 including four anchoring projections 42. Therefore, floor 12 includes sixteen anchor receiving orifices 24 arranged in a four-by-four array. However, it is recognized that more or less than four lateral walls 14 may be used in unloading pit 10, and more or less than four anchoring projections 42 may be used on each lateral wall 14.

Figure 4:
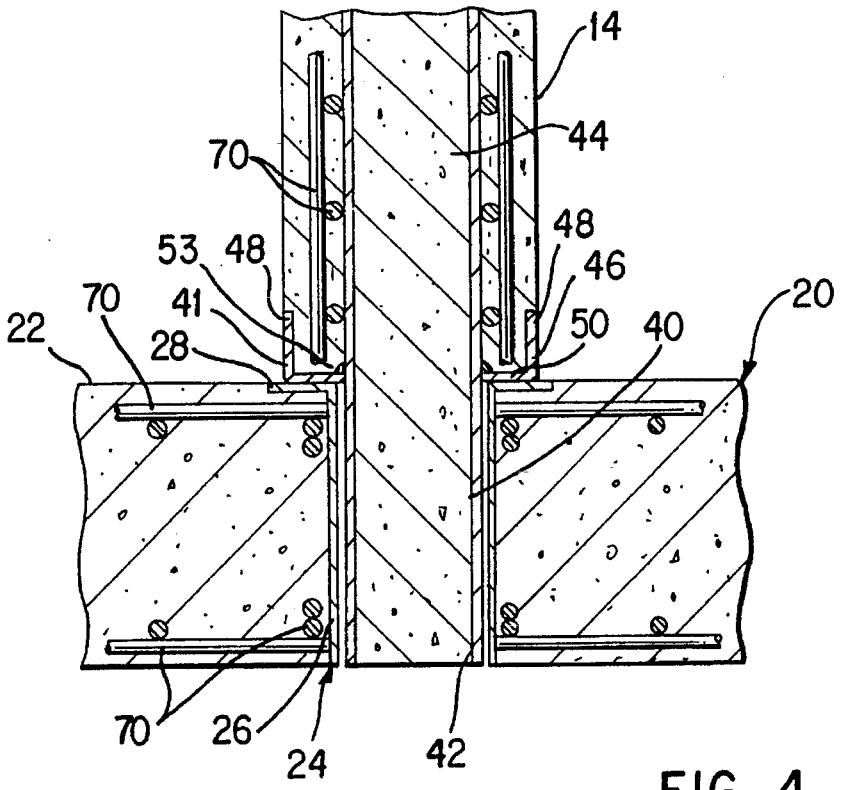
FIG. 4 is a magnification of detail 4 in FIG. 2 illustrating the interface between the bottom portion of a wall panel member and a floor member.

Each anchor receiving orifice 24 receives a corresponding anchoring projection 42 extending downwardly from the bottom of a lateral wall 14. As shown in FIG. 4, each anchor receiving orifice 24 includes a vertical sleeve formed of a square, or other rectangular shaped, hollow metal tube 26. While the shape of tube 26 is preferably rectangular, it is recognized that receiving tube 26 can be of any size provided that it is similarly shaped and slightly larger than anchoring projections 42. A more detailed description of anchoring projections 42 is provided hereinafter.

Floor 12 also includes laterally-oriented horizontal support plates 28 which are vertically located below each lateral wall 14. Horizontal support plates 28 are cast into floor panels 20 so that the top of support plates 28 are flush with the upper surface 22 of floor panels 20. Horizontal support plates 28 include perforations therein in the areas occupied above anchor receiving orifices 24. This enables each orifice 24 to receive a respective anchoring projection 42 without structural interference. To enhance the integrity and the force absorbing capability of floor 12, a row of receiving tubes 26 is welded to its respective horizontal support plate 28. As tubes 26 are fixed to horizontal support plates 28 prior to being cast into floor panels 20, the forming of floor panels 20 is facilitated, as the processing step of locating a horizontal support plate 28 with respect to a floor panel concrete mold inherently also locates a row of receiving tubes 26. Support plates 28 also include spaced anchors 31 extending from their lower surface to help mechanically lock support plates 28 into concrete floor panels 20.

Lateral walls 14 include floor interface devices, e.g., anchoring projections 42, which interface with the anchor receiving orifices 24 in floor 12. As shown in FIG. 4, each anchoring projection 42 includes a vertical metal bar 40. Bars 40 are sized and laterally spaced to correspond with the size and placement of anchor receiving orifices 24. Each bar 40 is rectangular shaped in cross section. However, as previously mentioned, other bar shapes can be used provided that the shape corresponds to the shape of anchor receiving orifices 24 in floor 12.

Each bar 40 is vertically oriented and extends substantially the entire height of its respective lateral wall 14. The upper end of each bar 40 is located at a position adjacent the top of the wall, while the lower end projects below the bottom surface 41 of the wall. The portion of each bars 40 which projects below the bottom surface of wall 14 serves as the anchoring projection 42. Bars 40 may be cast into lateral walls 14 hollow, or may be filled with concrete 44 to provide additional compressive strength.

The bottom surface 41 of each lateral wall 14 includes a U-channel 46 which extends across the length of lateral wall 14. U-channel 46 includes opposed vertical portions 48 and a horizontal portion 50 which forms the lateral wall bottom surface 41. Horizontal portion 50 is substantially planar and interfaces with the upper planar surface of a respective support plate 28. Vertical portions 48 of U-channel 46 permit the bottom corner edges of lateral walls 14 to be welded to support plate 28. Each U-channel 46 preferably includes laterally spaced anchors 52 bisecting the right angles created between vertical portions 48 and horizontal portion 50. As seen in FIG. 2, anchors 52 extend into the concrete lateral wall 14 for mechanically locking U-channel 46 to its respective lateral wall 14.

Horizontal portions 50 of U-channels 46 include laterally spaced holes 53 around bars 40 permitting anchoring projections 42 to extend therethrough. Accordingly, holes 53 are similarly spaced, and sized slightly larger than, the outer dimensions of bars 40. A row of bars 40 is welded to its respective U-channel 46 around the periphery of each hole 53 to create a rigid framework for lateral walls 14 and to enhance the structural interface between walls 14 and floor panels 20. Bars 40 and U-channels 46 are preferably unitized prior to being cast into the concrete to facilitate the forming of each lateral wall 14.

As shown in FIGS. 1 and 3, the top surface 54 of each lateral wall 14 includes two laterally spaced recesses 56 formed therein. Each recess 56 is capped with a rail support plate 58. Each rail support plate 58 is anchored to wall 14 by a pair of anchors 59 which are cast into lateral wall 14 and extend above the top surface 54. In a manner known in the art, support plate 58 and anchors 59 are used for fixedly attaching railroad tracks 18 to the concrete lateral wall 14. To more effectively transfer forces from rails 18 to the bottom of unloading pit 10, at least a portion of each rail support plate 58 is vertically superimposed above a portion of an anchoring projection 42, as best seen in FIGS. 1 and 3. Further, the entire attachment system of the floor 12 and walls 14 and 16 enables unloading pit 10 to adequately support the weight of a rail car on tracks 18.

Longitudinal wall 16 is oriented perpendicular to lateral walls 14 and extends continuously between the two outer lateral wails 14*a* and 14*d*. Longitudinal wall 16 is attached at its base to floor 12, and at its inner surface to each lateral wall 14 to unitize the panels and help form unloading pit 10. Additionally, longitudinal wail 16 is "keyed" to interface with each lateral wall 14. Inner vertical notches 60 and outer vertical notches 62 on longitudinal wall 16 interface with inner lateral walls 14*b* and 14*c* and outer lateral walls 14*a* and 14*d*, respectively, to achieve the "keyed" feature.

The width of inner notches 60 is slightly larger than the thickness of inner lateral walls 14*b* and 14*c* to receive the ends of a respective inner lateral wall 14*b* or 14*c*. Inner notches 60 aid in the alignment, and restrict the horizontal movement, of inner lateral walls 14*b* and 14*c*. Outer vertical notches 62 extend from the outer edges 61 of longitudinal wall 16 inward and are narrower than the thickness of outer lateral walls 14*a* and 14*d*. As best shown in FIG. 1, the edge of outer lateral walls 14*a* and 14*d* adjacent longitudinal wall 16 also includes a notch 63 to compliment the end of longitudinal wall 16 and its outer notch 62. Outer notches 62 aid in the alignment, and restrict the inward horizontal movement, of outer lateral walls 14*a* and 14*d*. Conventional hardware 64, e.g., angle brackets and bolts, is used to attach lateral walls 14 to longitudinal wall 16 adjacent notches 60 and 62.

Figure 5:
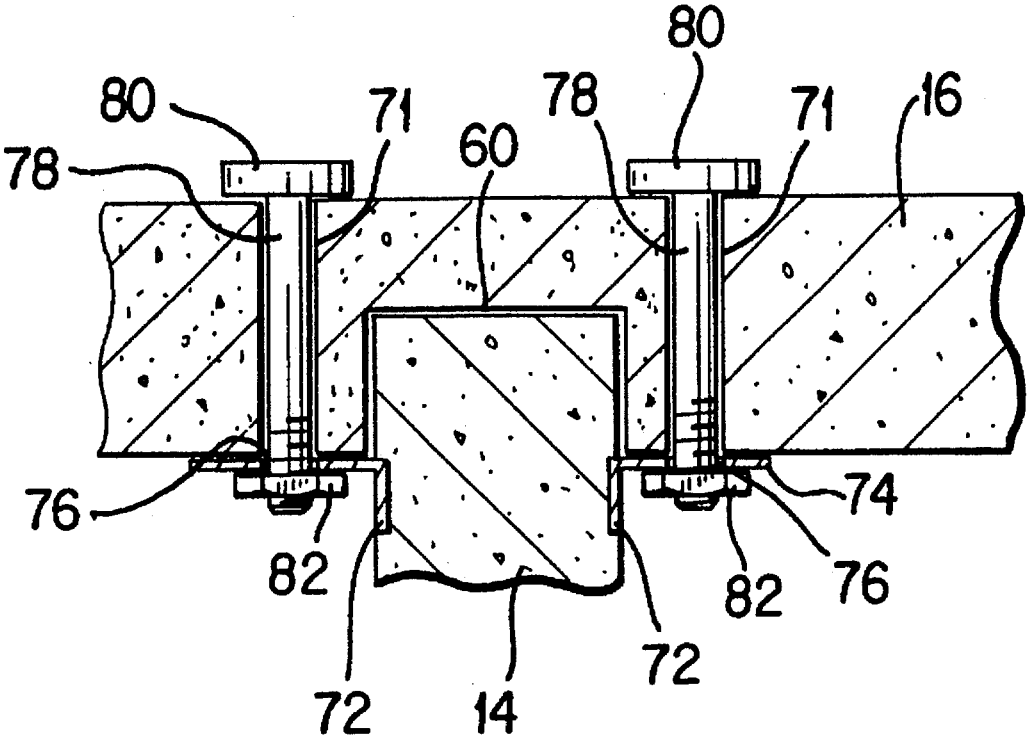
FIG. 5 is a cross-section through intersecting vertical wall panel members illustrating a preferred arrangement for attaching a lateral wall section to the longitudinal wall section.

In a preferred lateral wall-to-longitudinal wall attachment arrangement, as shown in FIG. 5, horizontal bore holes or sleeves 71 are located in longitudinal wall 16 adjacent its notches 60 and 62. L-shaped brackets 72 are cast within lateral wall 14, or are alternatively attached to lateral wall 14 by another technique. Each L-bracket 72 includes an outwardly extending flange 74 which is parallel to longitudinal wall 16, and which includes a hole 76 or slot therein. L-brackets 72 are sized and positioned such that each hole 76 aligns with a respective sleeve 71 when walls 14 and 16 are assembled. An anchor bolt 78 having an annular head 80 is inserted through each aligned sleeve 71 and hole 76 such that head 80 abuts against the outer surface of longitudinal wall 16. A nut 82 is threaded onto anchor bolt 78 at its other end securely affixing lateral wall 14 to longitudinal wall 16.

The bottom surface of longitudinal wall 16 preferably includes metal plate sections, not shown, which interface with metal plate portions, not shown, on the upper surface 22 of floor 12, in a manner similar to the interface between U-channels 46 and support plates 28. If desired, the base of longitudinal wall 16 can be welded to floor 12, or portions of floor 12, to fixedly attach longitudinal wall 16 directly to floor 12. Further, if desired, an anchoring system including anchoring projections and anchor receiving orifices may be also used to facilitate and strengthen the attachment between longitudinal wall 16 and floor 12.

To provide the panels with additional compressive strength, concrete panels 14, 16, and 20 are all preferably reinforced by a grid of steel bars 70 cast therein. As shown in FIG. 4, some of reinforcing bars 70 cast into lateral walls 14 and floor panels 20 are located immediately adjacent anchor receiving orifice 24 and bar 40 which strengthen the interfacing regions between floor 12 and the lateral walls 14.

Each panel member 14, 16, 20, and 30 is formed off-site in a manner to reduce production costs. A reusable mold is created for each panel design. The metal structure which is cast into the panels, e.g., reinforcing rods 70, U-channels 46 with bars 40 welded thereto, horizontal support plates 28 with tubes 26 welded thereto, etc., is accurately placed within the mold. Concrete is then poured into the mold to create the designated panel with its associated metal structure cast therein. A set of concrete panels, i.e., two floor panels 20, one floor joining member 30, four vertical lateral walls 14, and one vertical longitudinal wall 16, may then be shipped to a desired site for installation.

The desired site is excavated to accommodate the size of the unloading pit to be installed. The bottom of the excavation is levelled and the panels 20 and 30 are laid down and attached to one another to form floor 12. Lateral walls 14*a*–14*d* are then installed by placing the anchoring projections 42 into their respective anchor receiving orifice 24. Longitudinal wall 16 is installed by aligning notches 60 and 62 with the ends of lateral walls 14. Hardware 64 affixes lateral walls 14 to longitudinal wall 16. The lower corner edges of U-channels 46 on lateral walls 14 are welded to horizontal support plates 28 of floor 12 as needed to rigidly attach lateral walls 14 to floor 12. If desired, the bottom of longitudinal wall 16 may also be welded to floor 12 to rigidly attach longitudinal wall 16 directly to floor 12. A track section 18 may be assembled above unloading pit 10 at this site and the track section 18 will be supported by pit 10 at this site as previously described.

Once assembled, unloading pit 10 includes three longitudinally unloading compartments 17*a*–17*c* located underneath tracks 18. Each compartment 17 is defined by two adjacent longitudinally-spaced lateral wall sections 14, a portion of the longitudinal end wall 16, and a portion of floor 12. Each compartment 17 has an open side opposite longitudinal end wall 16 and an open top. A conveyor system 19 is mounted in each compartment 17 for transporting material discharged from bottom unloading rail cars to an aboveground area away from tracks 18.

Modular unloading pit 10 saves significant installation costs over cast-in-place unloading pits. As precast panels 14, 16, 20, and 30 of modular unloading pit 10 are pre-manufactured off-site, assembly of the modular unloading pit 10 can be completed in an excavated area in less than four days. In contrast, a cast-in-place unloading pit takes three-to-four weeks to install and requires considerably more installation man-hours than modular unloading pit 10. This reduced-time installation capability makes the unloading pit more feasible in a wide range of applications, including use on an active rail line.

Another major advantage associated with unloading pit 10 is that it is reusable. When the use of a modular unloading pit 10 at a first site is no longer required, the pre-cast panels 14, 16, 20 and 30 can be disassembled by removing the hardware, and cutting or burning the welds. The panels can then be transported to an excavated area at a subsequent site and reassembled as previously described. This entirely eliminates the concrete costs at subsequent sites, and significantly reduces the labor costs for installing an unloading pit at subsequent sites.

Additionally, modular unloading pit 10 is environmentally friendly. When unloading pit 10 is disassembled and removed, the excavation can be backfilled with the removed dirt leaving the earth undisturbed without burying any concrete remains therein.

Another benefit associated with modular unloading pit 10 is that shipping materials to a work site by rail is now more cost feasible, where the construction job is for a limited duration. Presently, materials are shipped along a rail as close as possible to the project site and are subsequently shipped by truck from that point to the desired construction site. With the capability to install unloading pit 10 in a short amount of time for an inexpensive cost, a rail spur could be routed from an active rail to an unloading pit 10 immediately adjacent, or closer to, the desired construction site. Such a capability would likely be significantly less effective for cast-in-place unloading pits. Further, when the project is finished, the unloading pit 10 could be removed and the excavation backfilled, leaving the site undisturbed.

Additionally, center panel 30 may include a hole therein, not shown, to permit a sump pump to be installed. This could help drain, and prevent any accumulation of, rain water in compartment 17*b* of unloading pit 10. Further, one or more holes could be located at the base of inner lateral walls 14*b* and 14*c* to permit connections from sump pump to extend through to drain any excess rain water from compartments 17*a* and 17*c*.

Further, while not as effective as the preferred embodiment described herein, it is recognized that anchoring projections could be designed to extend up from floor 12 and be received by anchor receiving orifices in lateral walls 14.

It is to be understood that the disclosed embodiments are merely illustrative of the principles of the present invention which could be implemented by other types of structures which would be readily apparent to those skilled in the art. Accordingly, the scope of the present invention is to be determined in accordance with the appended claims.

What is claimed is:

1. A modular unloading pit for containing a conveyer system to transport material unloaded from a rail car, said modular unloading pit being located beneath, and supporting, at least one rail for guiding the rail car, said modular unloading pit comprising:

a precast concrete floor; and a plurality of precast concrete lateral vertical walls;

said floor having wall interfacing means for interfacing with, and supporting, said lateral vertical walls;

said lateral vertical walls oriented perpendicular to the rail, each said lateral vertical wall having floor interfacing means for interfacing with said wall interfacing means of said floor, each said lateral vertical wall further having rail supporting means for contacting and supporting the rail.

2. The unloading pit of claim 1, each said lateral vertical wall having a bottom surface, said floor interfacing means including a plurality of laterally spaced anchoring projections extending below the bottom surface of said lateral vertical walls, said wall interfacing means including a plurality of sleeves, each sleeve sized and spaced to receive a respective one of said anchoring projections and restrict the movement of said lateral vertical walls with respect to said floor.

3. The unloading pit of claim 2, each said anchoring projection being formed from a metal bar cast into a respective lateral vertical wall, each said sleeve including a hollow metal tube having an inner opening, said inner opening being similarly shaped, and slightly larger than, a corresponding metal bar to prevent significant horizontal movement between the lateral vertical walls and the floor.

4. The unloading pit of claim 3, said floor further having horizontal steel reinforcing bars cast therein, at least four of said reinforcing bars being positioned immediately adjacent each said metal tube.

5. The unloading pit of claim 3, said floor having an upper planar surface, said unloading pit further comprising horizontal support plates affixed to said floor, said support plates having an upper surface being substantially coplanar with said upper planar surface of said floor, said lateral vertical walls having substantially horizontal base flange portions forming at least a portion of their bottom surface, said base flange portions supported by, and attached to, said support plates.

6. The unloading pit of claim 3, wherein each said metal bar is filled with concrete, said tube vertically extending substantially the entire height of its respective lateral vertical wall.

7. The unloading pit of claim 2, said rail supporting means comprises a recess in an upper surface of each said lateral vertical wall, and a rail support plate affixed within each said recess.

8. The unloading pit of claim 7, each said rail support plate being vertically superimposed above at least a portion of one of said anchoring projections.

9. The unloading pit of claim 1, further comprising a longitudinal vertical wall supported by said floor, said longitudinal vertical wall being substantially parallel to the rail and substantially perpendicular to said lateral vertical walls.

10. The unloading pit of claim 9, said longitudinal vertical wall comprising vertical notches therein, each said lateral vertical wall having an end portion received within a corresponding vertical notch.

11. The unloading pit of claim 1, said floor including two spaced floor panels and a center joining member positioned between, and attached to, said two spaced floor panels, each said floor panel including said wall interfacing means.

12. A method of unloading material from rail cars, the method including the steps of:

assembling a set of precast concrete panels inside an excavation at a first site to form a rail car unloading pit;

positioning a material conveying device inside the rail car unloading pit at the first site;

discharging material from a rail car into the rail car unloading pit at the first site;

conveying the discharged material away from the rail car unloading pit by the conveying device at the first site;

disassembling the rail car unloading pit at the first site;

transporting said set of precast concrete panels to a second site;

reassembling said set of precast concrete panels inside an excavation at the second site to form a second rail car unloading pit;

positioning a conveying device inside the second rail car unloading pit at the second site;

discharging material from a rail car into the second rail car unloading pit at the second site; and conveying the discharged material away from the second rail car unloading pit by the conveying device at the second site.

13. The method of claim 12, further comprising the step of backfilling the excavation at the first site leaving the filled excavation of the first site substantially void of concrete.

14. The method of claim 12, further comprising the steps of: assembling a rail car track section above the rail car unloading pit at the first site; and supporting the track section with the rail car unloading pit at the first site.

15. The method of claim 14, wherein said set of precast concrete panels comprise at least one floor panel and a plurality of vertical wall panels including at least two lateral vertical wall panels and at least one longitudinal vertical wail panel, said assembling step including supporting said lateral vertical wall panels by the floor panel substantially perpendicular to the track, and supporting said longitudinal vertical wall panel by the floor panel substantially parallel to the track.

16. The method of claim 15, wherein said longitudinal vertical wall panel includes a vertical notch therein, said assembling step further includes the step of inserting at least a portion of one of said lateral vertical wall panels into said vertical notch, and affixing said one lateral vertical wall panel to said longitudinal vertical wall panel.

17. The method of claim 16, wherein said lateral wall panels include anchoring projections extending from their lower surface and said floor panels include anchor receiving orifices, said assembling step further comprising inserting the anchoring projections into the anchor receiving orifices.

18. The method of claim 17, said assembling step further comprising the step of welding a portion of the lower surface of the lateral wall panels to the upper surface of the floor panel.

19. The method of claim 15, further comprising the step of affixing the conveying device to the rail car unloading pit.

20. In a rail car unloading pit having a floor, a plurality of lateral walls and a longitudinal wall, the lateral walls being attached to and supported by the floor, the longitudinal wall being supported by the floor and attached to the lateral walls, the lateral walls being substantially perpendicular to the longitudinal wall and including at least one rail supporting member for supporting a rail substantially perpendicular to the lateral walls and substantially parallel to the longitudinal wall, the improvement comprising:

said floor, said longitudinal wall and said lateral walls being precast concrete panels, one of said floor and said lateral walls having anchoring projections, the other of said floor and said lateral walls having anchor receiving sleeves, each said anchoring projection being located within a respective anchor receiving sleeve to accurately position the lateral walls with respect to said floor, and restrict relative movement between the lateral walls and the floor.

21. The improved rail car unloading pit of claim 20, wherein said lateral walls include said anchoring projections and said floor includes said anchor receiving sleeves, said anchoring projections extending downward from the bottom of said lateral walls.

22. The improved rail car unloading pit of claim 21, wherein said precast concrete panels include reinforcing bars cast therein.

23. The improved rail car unloading pit of claim 21, wherein said longitudinal wall includes a plurality of vertical notches therein, each of said lateral walls having an end portion at least partially located within a respective vertical notch.

24. The improved rail car unloading pit of claim 21, wherein each rail supporting member is vertically superimposed above at least a portion of an anchoring projection.

* * * * *